US005367223A

United States Patent [19]

Eccher

[11] Patent Number: 5,367,223

[45] Date of Patent: Nov. 22, 1994

[54] FLUORESENT LAMP CURRENT LEVEL CONTROLLER

[75] Inventor: Joseph A. Eccher, Loveland, Colo.

[73] Assignee: Hewlett-Packard Company, Palo Alto, Calif.

[21] Appl. No.: 137,390

[22] Filed: Oct. 14, 1993

Related U.S. Application Data

[63] Continuation of Ser. No. 816,025, Dec. 30, 1991, abandoned.

[51] Int. Cl.[5] ..... H05B 37/02

[52] U.S. Cl. ..... 315/97; 358/475; 315/105; 315/307; 315/DIG. 4; 315/DIG. 7; 315/156; 315/158; 315/219

[58] Field of Search ..... 315/94, 95, 97, 98, 315/102, 105, 291, 307, DIG. 4, DIG. 7, 209, 219, 156, 158; 358/474, 475

[56] References Cited

U.S. PATENT DOCUMENTS

| | | | |
|---|---|---|---|
| Re. 31,603 | 6/1984 | Christensen | 128/33 |
| 3,863,102 | 1/1975 | Herzog | 315/105 |
| 3,875,458 | 4/1975 | Kappenhagen | 315/194 |
| 4,087,722 | 5/1978 | Hancock | 315/200 |
| 4,240,009 | 12/1980 | Paul | 315/224 |
| 4,286,195 | 8/1981 | Swinea, Jr. | 315/224 |
| 4,350,933 | 9/1982 | Agarwala et al. | 315/278 |
| 4,358,710 | 11/1982 | Magai | 315/101 |
| 4,358,716 | 11/1982 | Cordes et al. | 315/306 |
| 4,370,600 | 1/1983 | Zansky | 315/209 R |
| 4,392,086 | 7/1983 | Ide et al. | 315/174 |
| 4,392,087 | 7/1983 | Zansky | 315/219 |
| 4,464,606 | 8/1984 | Kane | 315/158 |
| 4,663,570 | 5/1987 | Luchaco et al. | 315/219 |
| 4,682,083 | 7/1987 | Alley | 315/307 |
| 4,687,919 | 8/1987 | Nagano | 315/151 |
| 4,797,599 | 1/1989 | Ference et al. | 315/194 |
| 4,870,327 | 9/1989 | Jorgensen et al. | 315/307 |
| 4,920,299 | 4/1990 | Presz et al. | 315/105 |
| 4,933,605 | 6/1990 | Quazi et al. | 315/DIG. 4 |
| 4,958,108 | 9/1990 | Jorgensen | 315/307 |
| 4,970,437 | 11/1990 | Stevens | 315/209 |
| 5,030,887 | 7/1991 | Guisinger | 315/DIG. 7 |

FOREIGN PATENT DOCUMENTS

| | | | |
|---|---|---|---|
| 0041364 | 3/1985 | Japan | 358/475 |

*Primary Examiner*—Benny Lee
*Assistant Examiner*—Michael B. Shingleton

[57] ABSTRACT

A method and apparatus for automatically adjusting the light intensity output of a fluorescent lamp of a document scanner. The fluorescent lamp current level control apparatus comprises preheating circuitry for applying low voltage pulses of alternating polarity across filaments of the lamp, the low voltage pulses sufficient to preheat the filaments but insufficient to cause the lamp to fluoresce; high voltage circuitry for applying high voltage pulses of alternating polarity across the lamp, the high voltage pulses sufficient to cause the lamp to fluoresce; and control circuitry for receiving a first signal (PWM (D)) indicative of a desired level of current in the filaments, sensing a current indicative of the actual level of current in the filaments, and controlling the high voltage circuitry to cause the actual level of current to tend toward the desired level of current.

17 Claims, 2 Drawing Sheets

26
12
F1
F2
F3
F4
T1
T2
L1
24V
CR1
POWER SWITCH Q3
30
POWER SWITCH Q6
32
CURRENT SENSE
40
POWER SWITCH Q7
34
POWER SWITCH Q8
36
+24VDC
CURRENT SENSE
42
POWER SWITCH Q9
38
DRIVERS
48A
48B
44
G
R2
R2
LOOP COMPENSATOR
46
AMP/FILTER 2VR-4D
52
50
Q
Q̄
÷2
CLK
PRE CLK
DOT-NOR
PULSE SHAPER
54
SWITCH MODE POWER SUPPLY REGULATOR IC UC3524AN
28
SHUTDOWN
OSC/SYNC
OSC
CLOCK
COMPARE
AMP
R S2
S1 Q
VREF
R1
R1
VR
+24VDC
LAMPON_L
PWM (D)
PREHEAT_L

FLUORESENT LAMP CURRENT LEVEL CONTROLLER

CROSS REFERENCE TO RELATED APPLICATION

This is a continuation of copending application Ser. No. 07/816,025 filed on Dec. 30, 1991, now abandoned.

FIELD OF THE INVENTION

The present invention generally relates to apparatus for energizing fluorescent lamps, and more particularly relates to circuitry for controlling current level and light or lumen output level of a fluorescent lamp of a document scanner.

BACKGROUND OF THE INVENTION

A document scanner is an apparatus that converts printed text into digital data by illuminating the text with a fluorescent lamp and applying optical character recognition methods to the text. A problem with prior art document scanners is that the light intensity produced by their fluorescent lamps varies as both a function of age and temperature. For example, when a fluorescent lamp is first energized, light output increases to a maximum value as the lamp warms up, but then decreases as the lamp temperature continues to rise, .until equilibrium is reached. Moreover, darkening of the ends of the fluorescent lamp bulb causes lumen output to decrease as the lamp ages (lamps generally exhibit a significant decrease in lumen output after about 100 hours of operation). Further, lumen output may change with changes in power supply output. The need to correct these problems has increased with the advent of color document scanners, since constant light intensity is necessary for accurate reproduction of color documents.

Therefore, an object of the present invention is to provide methods and apparatus for automatically maintaining the light output of a fluorescent lamp at a substantially uniform and controlled level. A further object of the present invention is to reduce end darkening and effects thereof, particularly in a document scanner.

SUMMARY OF THE INVENTION

Fluorescent lamp current level controllers in accordance with the present invention comprise means for preheating the filaments of a fluorescent lamp by applying low voltage pulses of alternating polarity across the filaments. The low voltage pulses are sufficient to preheat the filaments but insufficient to cause the lamp to fluoresce (i.e., light up). Fluorescent lamp controllers in accordance with the invention further comprise high voltage means for applying high voltage pulses of alternating polarity across filaments of the lamp, the high voltage pulses being sufficient to cause the lamp to, fluoresce. Also included are control means for receiving a first signal indicative of a desired level of current in the filaments, sensing a current indicative of the actual level of current in the filaments, and controlling the high voltage means to cause the actual level of current to tend toward the desired level of current.

In preferred embodiments of the invention the first signal is a pulse signal of a prescribed frequency and the preheating means comprises means for receiving the first signal and a control signal and generating, in response to a prescribed state of the control signal, second and third signals of a frequency approximately half the prescribed frequency of the first signal. Also included are a first transformer comprising secondary coils adapted to be coupled to the filaments of the lamp and a primary coil adapted to be coupled to a DC voltage source, and switch means for controlling current through the primary coil in response to the second and third signals. In preferred embodiments the first transformer comprises a center tap on the primary coil adapted to be coupled to the DC voltage source. The first transformer is preferably arranged to provide approximately 3 to 4 volts across the filaments of the lamp when a DC voltage of approximately 24 volts is applied to the center tap.

The high voltage means preferably comprises a switch mode power supply regulator; power switch means, comprising a power input terminal, a power output terminal and a control input terminal and adapted to be coupled via the power input terminal to a source of DC power, for outputting via the power output terminal a DC current in response to a control signal received from the switch mode power supply regulator via the control input terminal; and a second transformer comprising secondary coils adapted to be coupled to at least one of the filaments of the lamp and a primary coil which is either directly or indirectly coupled to the power output terminal of the power switch means. In preferred embodiments the second transformer comprises a center tap on the primary coil and the power output terminal of the power switch means is coupled at least indirectly to the center tap. Moreover, the second transformer is preferably arranged to provide approximately 600 volts across the lamp (or across two lamps), and switch means for controlling current through the primary coil of the second transformer in response to the second and third signals are preferably included.

The control means, in preferred embodiments, comprises a current sense resistor and amplifier arranged to provide a signal indicative of current through the primary coil of the second transformer. In addition, in preferred embodiments, an inductor is coupled between the power output terminal of the power switch means and the center tap of the second transformer. The inductor provides a measure of noise suppression, which is particularly useful when the invention is employed in a document scanner.

The present invention also encompasses document scanners comprising a fluorescent lamp; scanning means for scanning a predefined area illuminated by the lamp and detecting light reflected therefrom, and for providing output signals indicative of light intensity levels detected; at least one reference surface of substantially uniform reflectivity for reflecting light emitted by the lamp to the scanning means; microprocessor means for receiving the output signals from the scanning means and generating a first control signal indicative of a desired level of light output by or current in the lamp and a second control signal for preheating the lamp; and a current level controller in accordance with the foregoing description coupled between the microprocessor means and the lamp.

The present invention also encompasses methods for controlling a fluorescent lamp. Methods in accordance with the invention comprise the steps of: preheating filaments of the lamp, for approximately one second, by applying low voltage pulses of alternating polarity across the filaments, the low voltage pulses sufficient to preheat the filaments but insufficient to cause the lamp to fluoresce; applying high voltage pulses of alternating polarity across filaments of the lamp, the high voltage pulses timed to create minimal noise effects and sufficient to cause the lamp to fluoresce; receiving a first signal indicative of a desired level of current in the filaments; sensing a current indicative of the actual level of current in the filaments; and controlling the high voltage pulses to cause the actual level of current to tend toward the desired level of current.

Other features and advantages of the invention are described below in connection with a detailed description of preferred embodiments.

DETAILED DESCRIPTION OF PREFERRED EMBODIMENTS

Figure 1:
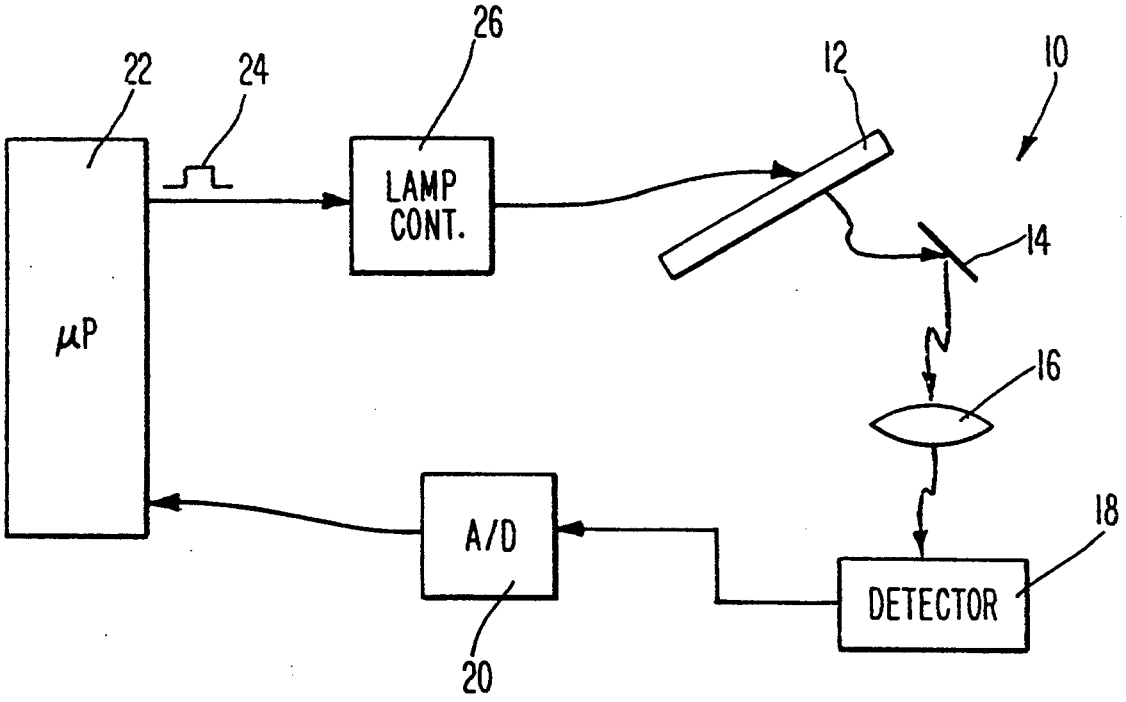
FIG. 1 is a block diagram of a document scanner comprising a fluorescent lamp controller in accordance with the present invention.

Referring now to the drawings, wherein like numerals represent like elements, FIG. 1 depicts a fluorescent lamp control system 10 in the context of a document scanner. The system comprises a fluorescent lamp 12 (typically including two tubular bulbs) for illuminating an area 14 to be scanned. Light reflected from the area 14 is focused by optical means 16 (e.g., a lens) onto light detection means 18 which provide analog output signals having magnitudes indicative of intensity levels of reflected light detected thereby. The analog output signals are converted to digital signals by an analog to digital (A/D) converter 20 and supplied to a microprocessor 22 for processing in a manner described below. Microprocessor 22 supplies control signals 24 (LAMPON_L, PWM(D), PREHEAT_L, see FIG. 2) to a fluorescent lamp control circuit 26 to adjust the input power or current supplied to lamp 12. The output light intensity produced by the lamp 12 will vary as input power (or current) is varied.

Figure 2:
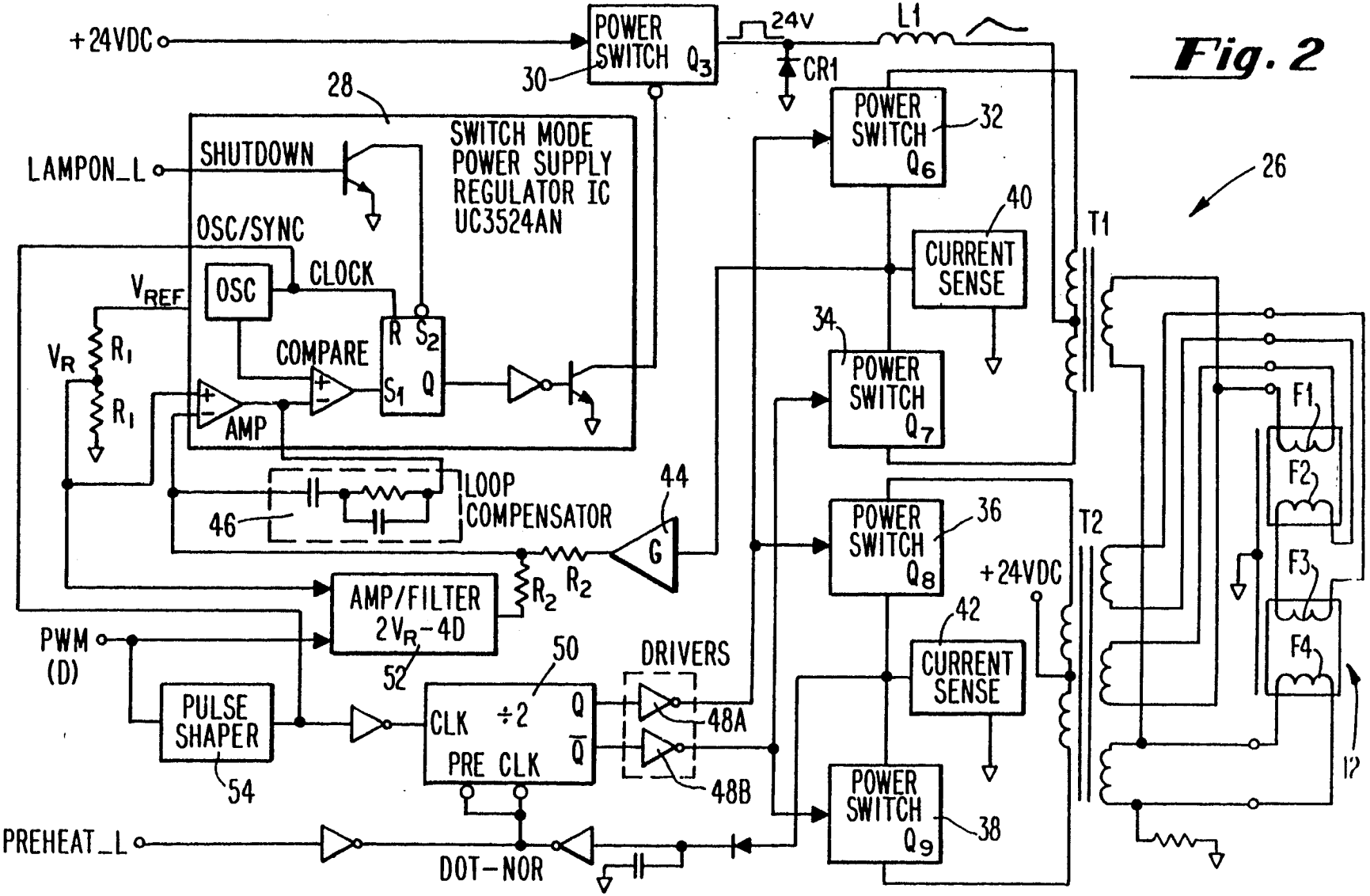
FIG. 2 is a block diagram of a fluorescent lamp current level/light output control circuit in accordance with the present invention.

As mentioned, A/D converter 20 receives and digitalizes the analog output signals provided by the light detecting means 18. The lamp driver circuit 26 receives control signals from microprocessor 22 for controlling the input power to the lamp 12, so that the lamp intensity is altered with alterations in input power. In a preferred embodiment of the invention, the control signal 24 for controlling the light output level is a PWM (pulse width modulated) signal with a duty cycle D (accordingly, this signal is represented in FIG. 2 as PWM(D)). The operation of controller 26 is such that the input power, particularly the current, to the lamp 12 is varied in proportion to variations in the duty cycle D of control signal 24. Moreover, the control circuit 26 includes means for preheating the lamp filaments before the lamp is turned on, which has been found to prevent darkening of the ends of the bulb, and is synchronized in a manner that minimizes the effects of any noise generated.

The fluorescent lamp current level control circuit 26 is depicted in greater detail in FIG. 2. The control circuit 26 includes circuitry, referred to herein as preheating means, for applying approximately 3.6 V pulses of alternating polarity across filaments F1, F2, F3, F4 of the lamp 12 (the lamp includes two tubular bulbs, as shown). These low voltage pulses are sufficient to preheat the filaments but insufficient to cause the lamp to fluoresce. Preheating the filaments for approximately one second has been found to substantially reduce the darkening that typically occurs at the ends of the bulbs.

Preheating is effected by bringing the signal PREHEAT_L low (this is an active low signal), which causes a divider circuit 50, which comprises a 74HCT74 IC, to output pulses onto its Q, $\overline{Q}$ output terminals at half the frequency of the PWM signal. In the preferred embodiment of FIG. 2 the frequency of the PWM signal is 100 kHz. The respective output signals of the divider 50 are amplified and inverted by FET drivers 48A, 48B (which are MC34151P ICs in the preferred embodiment). The output of FET driver 48A controls two FET power switches 32, 36 and the output of FET driver 48B controls FET power switches 34, 38.

As shown, a 24 VDC voltage is applied to a center tap of the primary coil of transformer T2; thus the pulses generated by the respective FET drivers 48A, 48B, which are out of phase with respect to each other, cause the respective halves of the primary coil to conduct alternating, oppositely directed current pulses. These alternating pulses cause a voltage of approximately 7.2 V to be induced across the topmost secondary coil of transformer T2 and a voltage of approximately 3.6 V to be induced across the other two coils (the topmost secondary coil of transformer T2 has twice as many turns as each of the other secondary coils). In addition, the topmost secondary coil of transformer T2 is coupled in series to the two filaments F2, F3, so a voltage of approximately 3.6 V will be applied across each filament. The center secondary coil is coupled to filament F1 and the by the primary of transformer T1, and the 60 volts is stepped up by the turns ratio of 10:1 (i.e., 10 turns of the secondary coil for each turn on each half of the primary coil) to 600 volts. (In other words, 120 volts are applied across the entire primary and stepped up 5 times to 600 volts across the secondary coil.) This 600 volts causes the lamp to fluoresce.

The amount of current through the primary coils of transformer T1 is proportional to the duty cycle of the PWM signal. A current sense element 40 (e.g., a current sense resistor) and a gain amplifier 44 are used to feed back the actual current level through the respective primary coils to the switch mode power supply regulator 28.

The output of amplifier/filter 52 is given by the expression $$V_{52}=2V_R-4D.$$

The output of the current gain amplifier 44 is given by $$V_{44}=GR_SI,$$

where $R_S$ represents the resistance of the current sense element 40 and G represents the amplifier's gain. The voltages $V_{52}$, $V_{44}$ and $V_R$ are applied to the amplifier, labelled "AMP", in regulator 28 This amplifier (AMP), the resistors labelled 43, 45 and having a resistance $R_2$ and the loop compensator 46 perform the function of an integrator. A simplified expression of the output of the amplifier (AMP) is $$V_{OUT} = -1/R_2CS(2V_R - 4D) - (1/R_2CS)GR_SI + (1 + 2/R_2CS)V_R$$
$$= (4D - IR_SG)/R_2CS + V_R,$$

where D represents the duty cycle, C represents the capacitance of the loop compensator 46 (i.e., the series capacitance in loop compensator 46), S represents the Laplace Transform operator and I represents the primary current of transformer T1. $V_{OUT}$ will become stable when the loop reaches a steady state, i.e., when $$, 4D-IR_SG=0,$$

or $$, I=4D/R_SG.$$

This means that, if $R_S=0.05\Omega$ and $G=16.4$, the current I will equal 4.88D, with $0 \leqq D \leqq 1$. The secondary current of bottom secondary coil is coupled to filament F4, thus each of those filaments also receives approximately 3.6 V. This has been found to be sufficient to preheat the filaments without causing the lamp to fluoresce. The vertical bar to the left of the lamp 12 indicates that there must be a ground plane near the lamp (the specific ground plane spacing required for a particular lamp is typically specified by the lamp's manufacturer). The lamp of the preferred embodiment is a Sylvania part no. F13T5 fluorescent lamp.

Although the PWM pulses have a variable width, their trailing edges may be used to synchronize the entire circuit; therefore a pulse shaper 54 is employed to generate standardized pulses synchronized to the trailing edges of the PWM pulses. Once the preheat signal PREHEAT_L goes low, the divider 50 is enabled and generates pulses at half the frequency of the signal output by the pulse shaper 24. The preferred procedure is to turn the preheat signal on (i.e., bring PREHEAT_L low) about one second before the lamp is turned on. This simultaneously enables the FET power switches 32, 34, 36, 38, however FET power switch 30 controlling power to transformer T1 is not driven because the lamp has not been turned on yet. The lamp is instructed to turn on with the LAMPON_L n signal (also an active low signal), which activates a switch mode power supply regulator 28.

The switch mode power supply regulator 28 of the preferred embodiment is a UC3524AN IC available from Unitrode Corporation. This device drives power switch 30, which in response to the drive pulses outputs 24 VDC pulses, which are smoothed by inductor L1 and applied to the center tap of transformer T1. Transformer T1 operates like transformer T2, except that transformer T1 generates high-voltage pulses across its secondary. When the LAMPON_L signal goes low, the voltage generated across the secondary of transformer T1 is approximately 600 volts. This is due to the large voltage generated by the primary coil of transformer T1 and the avalanching of transistors (i.e. power switches) 32 and 34 at approximately 120 volts. This voltage is divided to 60 volts transformer T1 (the lamp current $I_{LAMP}$) will be one-tenth of the primary current, or 0.488 D, when the PWM signal varies between 0 and 5 volts. The voltage $V_{OUT}$ provides a signal that is used to control the output of regulator 28 to correctly set the on/off ratio of power switch 30, which in turn maintains the commanded level of current to the lamp 12.

Other aspects of the structure and operation of the circuit of FIG. 2 will be apparent to those skilled in the art, however a few important points regarding the circuit will be noted:

1. The fluorescent lamp current level controller maintains a commanded lamp current level using a closed loop current averaging technique. The lamp light output level is proportional to the commanded lamp current.

2. The lamp filaments are preheated to significantly reduce end darkening and effects thereof, and to extend lamp life.

3. The high voltage required to start the lamp is developed from the avalanche voltage of power switches 32 and 34. No other source of high voltage is necessary.

4. The current command signal can be either a DC voltage or a PWM signal. If the current command is a DC voltage, the pulse shaper 54 may be deleted and the oscillator (OSC) output of the switch mode power supply regulator 28 may be input to the CLK input of divider block 50.

5. The power switches 30, 32, 34, 36, 38 are synchronized with the PWM signal, which allows the switches to be triggered at times when the noise generated by the high voltage will least affect surrounding circuitry, e.g., at times when the light detectors are idle.

6. It is unnecessary to bring the signal PREHEAT_L high after the lamp is turned on. Further, the lamp has been found to turn on quicker after it has been preheated, as compared to its turn on time without preheating. In an experiment, one bulb came on before the second bulb, taking a total of 6700 milliseconds. However, once the filaments were preheated, which cost approximately one second, the bulbs came on within 3 to 4 milliseconds. Further, there was no noticeable sequencing or flickering of the bulbs; both bulbs essentially came on instantaneously.

Many modifications, changes and variations of the preferred embodiments will become apparent to those skilled in the art after considering the specification and accompanying drawings. All such changes, modifications and variations within the true spirit and scope of the invention are intended to be covered by the following claims.

What is claimed is:

1. A document scanner, comprising:

(a) at least one fluorescent lamp comprising at least one filament;

(b) light detection means comprising a plurality of light detectors for scanning a predefined area illuminated by said lamp and detecting light reflected therefrom, and for providing output signals indicative of detected light intensity levels;

(c) microprocessor means, coupled to said light detection means, for receiving said output signals and generating a first control signal indicative of a desired level of current in said lamp and a second control signal; and (d) a current level controller coupled between said microprocessor means and said lamp(s) and comprising:

(i) preheating means for applying, in response to a predefined state of said second control signal, low voltage pulses of alternating polarity across said filament(s), said low voltage pulses sufficient to preheat said filament(s) but insufficient to cause said lamp to fluoresce, said preheating means comprising a first transformer comprising a secondary coil coupled to at least one filament and a primary coil adapted to be coupled to a DC voltage source;

(ii) high voltage means for applying high voltage pulses of alternating polarity across said filament(s), said high voltage pulses being generated at times when said light detectors are idle and sufficient to cause said lamp to fluoresce, said high voltage means comprising a second transformer comprising a secondary coil coupled to at least one filament and a primary coil; and (iii) control means for receiving said first control signal, sensing a current indicative of the actual level of current in said lamp, and controlling said high voltage means to cause said actual level of current to tend toward said desired level of current, said control means comprising means for providing a signal indicative of current through said primary coil of said second transformer.

2. A document scanner as recited in claim 1, wherein said first control signal is a pulse signal of a prescribed frequency and said preheating means further comprises:

means for receiving said first control signal and said second control signal and generating, in response to a prescribed state of said second control signal, third and fourth signals of a frequency approximately half said prescribed frequency of said first control signal; and switch means for controlling current through said primary coil in response to said third and fourth signals.

3. A document scanner as recited in claim 2, wherein:

said first transformer comprises a center tap on said primary coil and said DC voltage source is coupled to said center tap; and said first transformer is arranged to provide approximately 3 to 4 volts across said filament when said DC voltage is approximately 24 volts.

4. A document scanner as recited in claim 3, wherein said high voltage means further comprises:

a switch mode power supply regulator; and power switch means, comprising a power input terminal, a power output terminal coupled either directly or indirectly to said primary coal of said second transformer and a control input terminal and adapted to be coupled via said power input terminal to a source of DC power, for outputting via said power output terminal a DC current in response to a control signal received from said switch mode power supply regulator via said control input terminal.

5. A document scanner as recited in claim 4, wherein:

said second transformer comprises a center tap on said primary coil and said power output terminal of said power switch means is coupled at least indirectly to said center tap; and said second transformer is arranged to provide approximately 600 volts across its secondary coil.

6. A document scanner as recited in claim 5, further comprising switch means for controlling current through said primary coil of said second transformer in response to said third and fourth signals.

7. A document scanner as recited in claim 6, wherein said control means further comprises a current sense resistor and amplifier arranged to provide a signal indicative of current through said primary coil of said second transformer.

8. A document scanner as recited in claim 7, further comprising an inductor coupled between said power output terminal of said power switch means and said center tap of said second transformer.

9. A document scanner as recited in claim 8, wherein said first control signal is a pulse width modulated (PWM) signal and output light intensity produced by said lamp is adjustable by varying the width of the pulses of the PWM signal.

10. A method for controlling a fluorescent lamp or lamps in a document scanner comprising a plurality of light detectors for scanning a document, comprising the steps of:

(a) preheating filaments of said lamp or lamps, for approximately one second, by applying low voltage pulses of alternating polarity across said filaments, said low voltage pulses sufficient to preheat said filaments but insufficient to cause said lamp or lamps to fluoresce;

(b) generating high voltage pulses by effecting avalanching of at least one power switch and applying said high voltage pulses of alternating polarity across said lamp or lamps, said high voltage pulses generated at times when said light detectors are idle and sufficient to cause said lamp(s) to fluoresce;

(c) receiving a first signal indicative of a desired level of current in said lamp(s);

(d) sensing a current indicative of the actual level of current in said lamp(s); and (e) controlling said high voltage pulses to cause said actual level of current to tend toward said desired level of current.

11. A document scanner, comprising:

(a) a fluorescent lamp;

(b) light detection circuitry comprising a plurality of light detectors for scanning an area illuminated by said lamp and detecting light reflected therefrom, and for providing output signals indicative of detected light intensity levels; and (c) a current level controller coupled to said lamp and comprising a power switch generating high voltage pulses of alternating polarity to cause said lamp to fluoresce, said high voltage pulses being synchronized with the triggering of said power switch, said triggering occurring at times when said light detectors are idle.

12. A document scanner as recited in claim 11, further comprising a control circuit, coupled between said light detection circuitry and current level controller, for receiving said output signals and generating a pulse width modulation (PWM) control signal controlling the triggering of said power switch and the light intensity provided by said lamp, said PWM control signal being characterized by a fixed frequency.

13. A document scanner as recited in claim 11, further comprising preheating means for applying low voltage pulses of alternating polarity across a filament of said lamp, said low voltage pulses being sufficient to preheat said filament but insufficient to cause said lamp to fluoresce.

14. A document scanner as recited in claim 12, further comprising preheating means for applying low voltage pulses of alternating polarity across a filament of said lamp, said low voltage pulses being sufficient to preheat said filament but insufficient to cause said lamp to fluoresce.

15. A method for controlling a fluorescent lamp in a document scanner having a plurality of light detectors, comprising the steps of:

(a) generating high voltage pulses and applying said high voltage pulses across said lamp, said high voltage pulses being generated at times when said light detectors are idle;

(b) sensing a current indicative of a level of current in said lamp; and (c) controlling said high voltage pulses to cause said level of current in said lamp to tend toward a desired level of current.

16. A method as recited in claim 15, wherein said high voltage pulses are generated by effecting avalanching of at least one power switch.

17. A method as recited in claim 15, wherein said high voltage pulses are generated by generating a pulse width modulation (PWM) control signal and controlling the triggering of a power switch with said PWM control signal, said PWM control signal being characterized by a fixed frequency.

* * * * *